US008316897B2

(12) United States Patent
Lucas

(10) Patent No.: US 8,316,897 B2
(45) Date of Patent: Nov. 27, 2012

(54) WATER GUN ASSEMBLY

(75) Inventor: Christopher Francis Lucas, Cheektowaga, NY (US)

(73) Assignee: Mattel, Inc., El Segundo, CA (US)

( * ) Notice: Subject to any disclaimer, the term of this patent is extended or adjusted under 35 U.S.C. 154(b) by 471 days.

(21) Appl. No.: 12/692,780

(22) Filed: Jan. 25, 2010

(65) Prior Publication Data

US 2010/0269953 A1 Oct. 28, 2010

Related U.S. Application Data

(60) Provisional application No. 61/147,113, filed on Jan. 25, 2009.

(51) Int. Cl.
*B65B 1/04* (2006.01)

(52) U.S. Cl. ..... 141/18; 141/369; 141/113; 222/79; 446/473

(58) Field of Classification Search ..... 222/78, 222/79; 446/473; 141/18, 21, 25–27, 67, 141/351, 369, 383, 392, 113
See application file for complete search history.

(56) References Cited

U.S. PATENT DOCUMENTS

| | | | |
|---|---|---|---|
| 600,552 | A | 3/1898 | Parker |
| 3,486,539 | A | 12/1969 | Jacuzzi |
| 3,499,444 | A | 3/1970 | Koutsandreas |
| 3,509,584 | A | 5/1970 | Sable |
| 3,843,127 | A | 10/1974 | Lack |
| 3,848,808 | A | 11/1974 | Fetty et al. |
| 3,874,836 | A | 4/1975 | Johnson et al. |
| 3,883,146 | A | 5/1975 | Johnson et al. |
| 3,952,170 | A | 4/1976 | Irvin et al. |
| 4,111,430 | A | 9/1978 | Johnson |
| 4,165,073 | A | 8/1979 | Kellerstrass |
| D254,250 | S | 2/1980 | Carey et al. |
| D261,264 | S | 10/1981 | Carey et al. |
| 4,298,976 | A | 11/1981 | Irvin et al. |
| 4,591,071 | A | 5/1986 | Johnson |
| 4,735,239 | A | 4/1988 | Salmon et al. |

(Continued)

FOREIGN PATENT DOCUMENTS

JP 07063497 3/1995

OTHER PUBLICATIONS

"Speedloader: Power Surge 2500", product information from www.isoaker.com/Armoury?soaker_stats.cfm?soakerID=slpowersu . . . , 4 pages, (c) 2000-2007.

(Continued)

*Primary Examiner* — Timothy L Maust
*Assistant Examiner* — Jason K Niesz
(74) *Attorney, Agent, or Firm* — Edell, Shapiro & Finnan, LLC

(57) ABSTRACT

A toy water gun assembly is disclosed. The assembly includes a water gun and a filling station. The filling station connects to a water source such as a hose. The gun connects to the filling station such that, when connected, the trigger is secured in a locked stated, preventing the user from discharging the gun while mounted on the station. In operation, the gun is connected to the filling station until the water reservoir on the gun is filled. The gun is then released from the filling station by engaging a release lever or button. The gun is fully charged, with the water being pressurized during the filling process.

20 Claims, 13 Drawing Sheets

U.S. PATENT DOCUMENTS

| | | | |
|---|---|---|---|
| 4,757,946 | A | 7/1988 | Johnson |
| 4,867,208 | A | 9/1989 | Fitzgerald et al. |
| 5,074,437 | A | 12/1991 | D'Andrade et al. |
| 5,080,652 | A | 1/1992 | Sancoff et al. |
| 5,137,175 | A | 8/1992 | Kowalski et al. |
| 5,150,819 | A | 9/1992 | Johnson et al. |
| 5,238,149 | A | 8/1993 | Johnson et al. |
| 5,292,032 | A | 3/1994 | Johnson et al. |
| 5,305,919 | A | 4/1994 | Johnson et al. |
| 5,322,191 | A | 6/1994 | Johnson et al. |
| 5,366,108 | A | 11/1994 | Darling |
| 5,373,833 | A | 12/1994 | D'Andrade |
| 5,373,975 | A | 12/1994 | Husted |
| RE35,412 | E | 12/1996 | Johnson et al. |
| 5,758,800 | A | 6/1998 | D'Andrade |
| 5,779,100 | A | 7/1998 | Johnson |
| 5,799,827 | A | 9/1998 | D'Andrade |
| 5,826,750 | A | 10/1998 | Johnson |
| 5,850,941 | A | 12/1998 | Johnson et al. |
| 5,865,344 | A | 2/1999 | Nagel |
| 5,875,927 | A | 3/1999 | D'Andrade |
| 5,878,914 | A | 3/1999 | Johnson |
| 5,897,530 | A | 4/1999 | Jackson |
| 5,906,295 | A | 5/1999 | D'Andrade |
| 5,915,771 | A | 6/1999 | Amron |
| 6,000,386 | A | 12/1999 | Johnson et al. |
| 6,003,503 | A | 12/1999 | Johnson et al. |
| 6,012,609 | A | 1/2000 | D'Andrade |
| 6,138,871 | A | 10/2000 | D'Andrade |
| 6,167,925 | B1 | 1/2001 | D'Andrade et al. |
| 6,193,107 | B1 | 2/2001 | D'Andrade |
| 6,203,397 | B1 | 3/2001 | Applewhite et al. |
| 6,234,347 | B1 * | 5/2001 | Amron ..... 222/1 |
| 6,347,623 | B1 | 2/2002 | Kownacki et al. |
| 6,446,837 | B2 | 9/2002 | Crawford |
| 6,540,108 | B1 | 4/2003 | Johnson |
| 6,651,702 | B2 * | 11/2003 | Marino ..... 141/26 |
| 6,659,366 | B1 | 12/2003 | Walters |
| 6,698,414 | B1 | 3/2004 | Menow et al. |
| 6,802,756 | B2 | 10/2004 | Zimmerman |
| 6,892,902 | B2 | 5/2005 | Hornsby et al. |
| 6,929,151 | B1 * | 8/2005 | Clayton ..... 222/79 |
| 6,994,126 | B2 | 2/2006 | Marino |
| 7,097,073 | B2 | 8/2006 | Zimmerman |
| 7,131,557 | B2 | 11/2006 | Zimmerman et al. |
| 2004/0159368 | A1 | 8/2004 | Eddins et al. |
| 2004/0206771 | A1 | 10/2004 | Junkel |
| 2006/0081645 | A1 | 4/2006 | Junkel |
| 2006/0097004 | A1 | 5/2006 | Junkel |

OTHER PUBLICATIONS

Product Photographs of "Speedloader Double Cross 3000", product and packaging with label of (c) 1998 YES! Entertainment Corporation, 9 pages.

* cited by examiner

WATER GUN ASSEMBLY

CROSS-REFERENCE TO RELATED APPLICATION

This application claims priority to and the benefit of U.S. Provisional Patent Application No. 61/147,113, filed Jan. 25, 2009, entitled "Water Gun Assembly," the entire disclosure of which is incorporated herein by reference in its entirety.

FIELD OF THE INVENTION

The present invention is directed to a toy water gun assembly and, in particular, to a playset including a water gun and a refilling station.

BACKGROUND OF THE INVENTION

Water pistols (or squirt guns) have been popular toys for many years. A common type of water gun has a trigger-operated pump mechanism for pressurizing and ejecting a relatively small, short duration jet of water. The guns use the interior of a hollow plastic gun body as the (non-pressurized) water reservoir. These "single shot" water guns, having a non-pressurized water reservoir and a trigger pump, are limited in range, as well as in the length and duration of the water jet.

More recently, water guns that incorporate a large reservoir of water that is pressurized by a pumping action by the user have become popular. This type of water gun is capable of propelling a jet of water farther and for a duration that is controlled by the depression of the trigger mechanism (so long as there is pressure in the reservoir). The vast majority of such water guns include a manually-operated pump for developing a pressure head of air in the water reservoir. Operation of a trigger controls the water formation and duration of the water jet. Pressurized reservoir types of water guns require a great deal of manual pumping to produce a suitable pressure head in the reservoir.

Other guns connect to a frame that, in turn, is connected to a continuous source of pressurized water. These guns, however, are not portable because the user must remain with the frame in order to use the gun. In addition, since the gun is directly fed by a pressurized water source, injury can be caused when the pressure level of the source is too high for young children.

Thus, it would be desirable to provide a water gun assembly that is easy to use, and is safe for use by children.

SUMMARY OF THE INVENTION

A toy water gun assembly is disclosed. The assembly includes a water gun and a filling station. The filling station connects to a water source such as a hose. The gun connects to the filling station such that, when connected, the trigger is secured in a locked state, preventing the user from discharging the gun while mounted on the station. In operation, the gun is connected to the filling station until the water reservoir on the gun is filled. The gun is then released from the filling station by engaging a release lever and the gun is fully charged, with the water being pressurized during the filling process.

BRIEF DESCRIPTION OF THE DRAWINGS

Like reference numerals have been used to identify like elements throughout this disclosure.

DETAILED DESCRIPTION OF THE INVENTION

Figure 1:
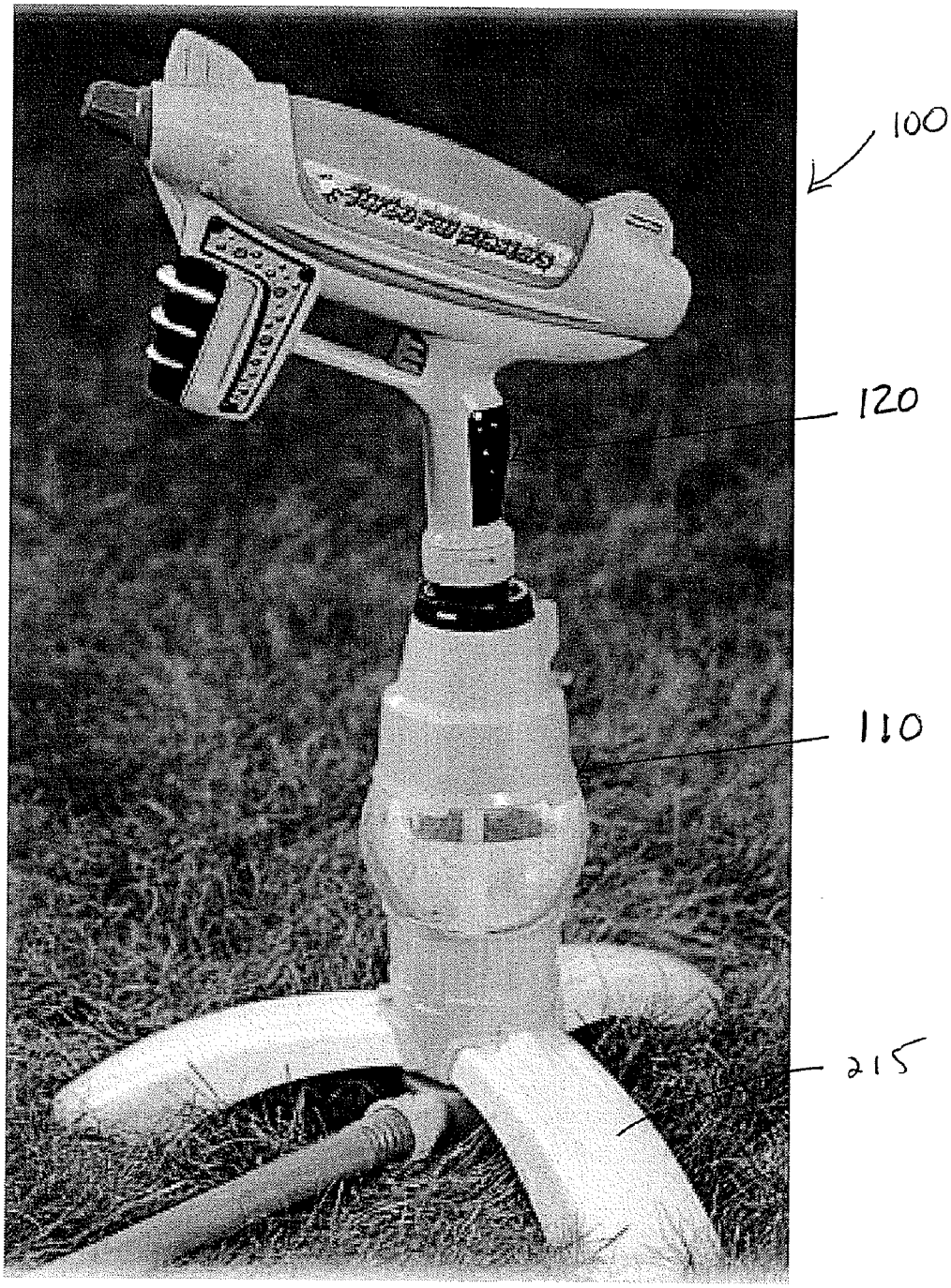
FIG. 1 illustrates a perspective view of a toy water gun assembly in accordance with an embodiment of the present invention.

FIG. 1 illustrates a perspective view of the water gun assembly 100 in accordance with an embodiment of the invention. As illustrated, the assembly 100 includes a filling station or base 110 and a discharge or water gun 120. The gun 120 includes a reservoir in which fluid can be stored. The filling station 110 is adapted to receive pressurized water from a pressurized water source and to selectively direct the water into the gun 120 for filling and pressurizing the gun's reservoir. The base 110 is supported by several support legs 215.

Figure 2:
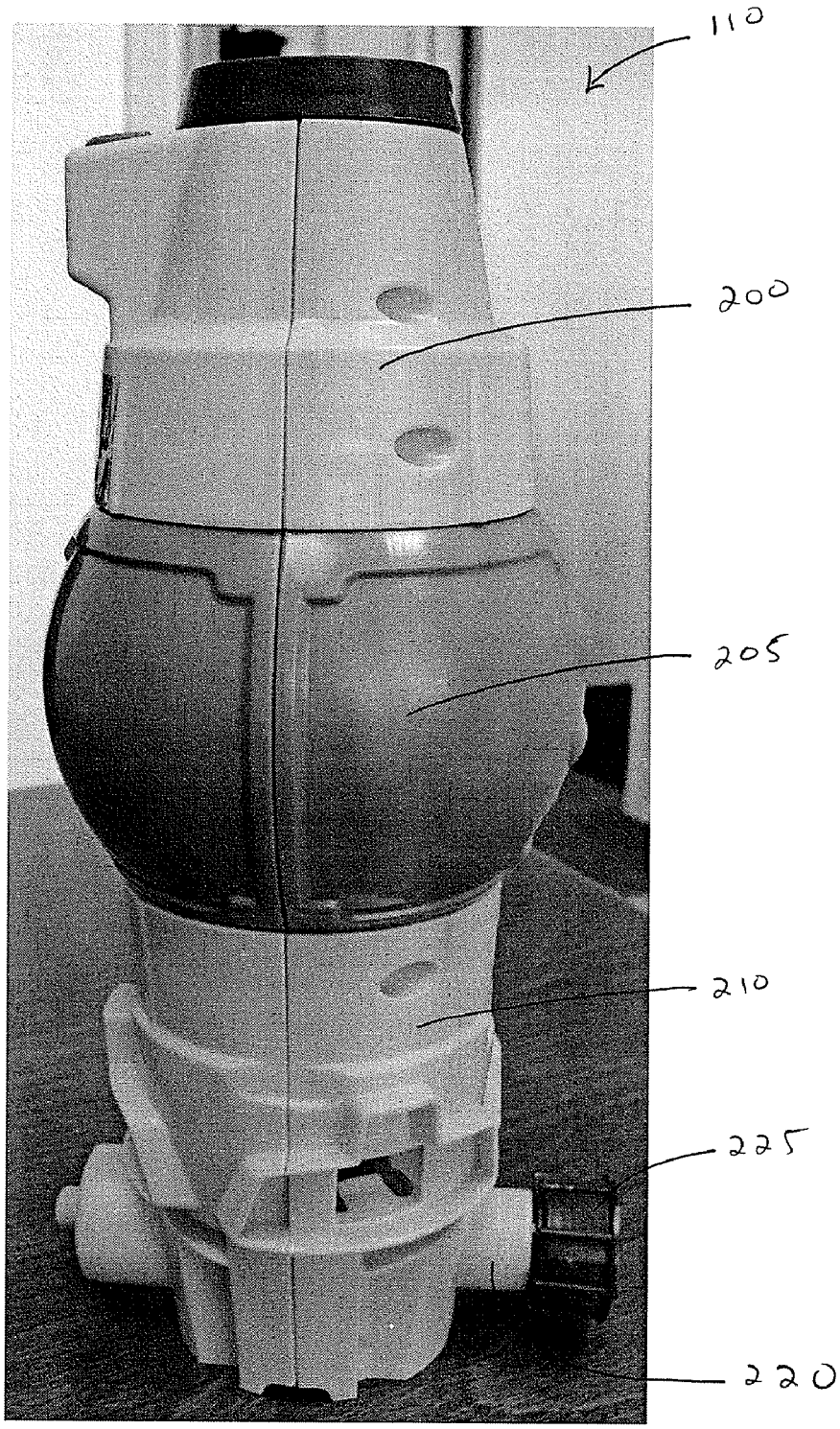
FIG. 2 illustrates an isolated view of a filling station in accordance with an embodiment of the invention.

FIG. 2 illustrates a perspective view of the filling station 110. In the embodiment shown, the filling station 110 includes an upper housing 200, a station tank 205, and a lower housing 210. The lower housing 210 may further include one or more support legs 215 (shown in FIG. 1) that support the filling station 110 in a generally upright orientation on a supporting surface such as the ground. A port 220 in fluid communication with the tank 205 extends transversely from the lower housing 210. The distal end of the port 220 may include a threaded hose connection 225 adapted to mate with a water source such as a garden hose, a hose bib, etc. The hose connection 225 may also be a quick-connect type of connection.

Figure 3A:
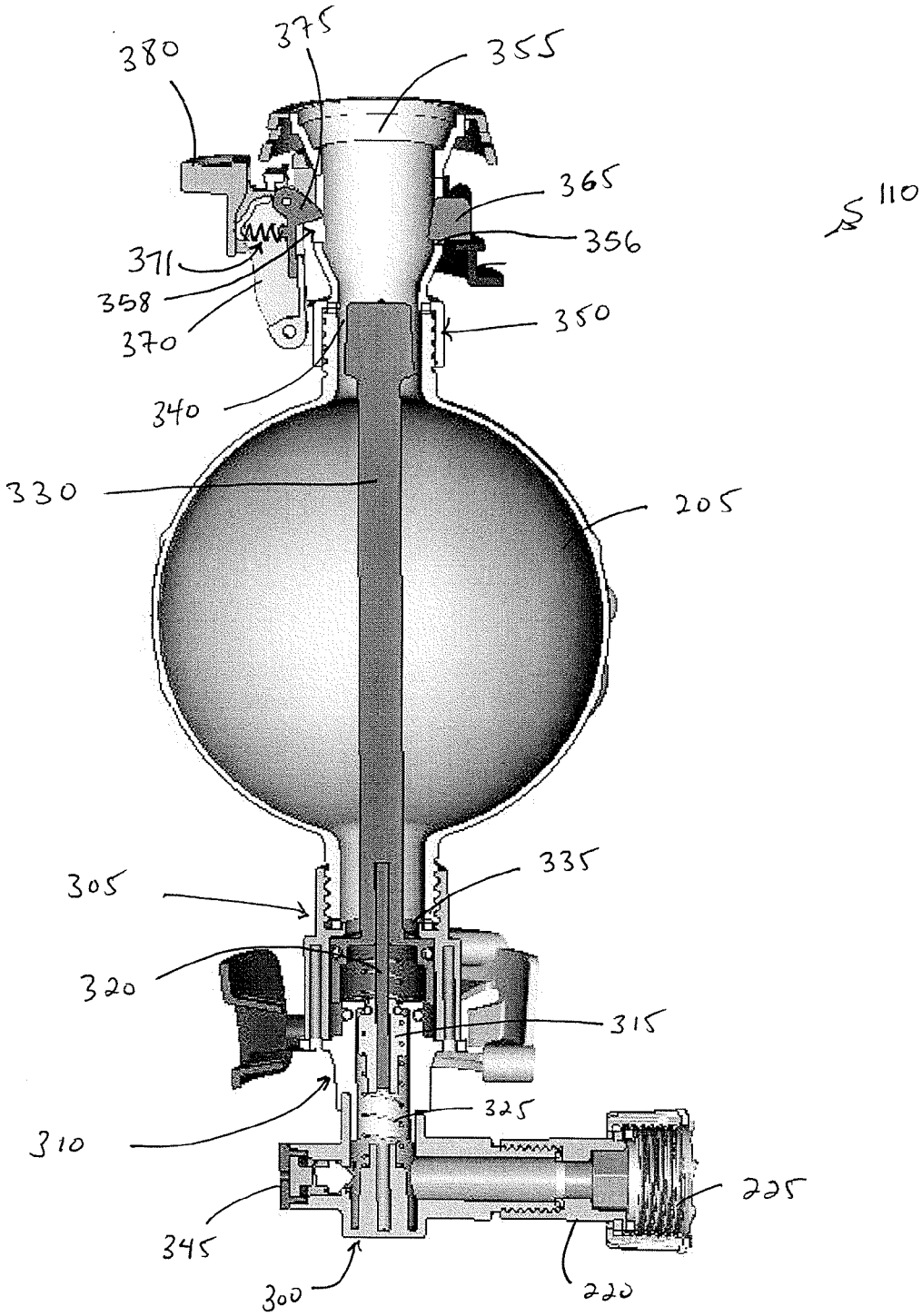
FIG. 3A illustrates a cross-sectional view of the filling station shown in FIG. 2.
Figure 3B:
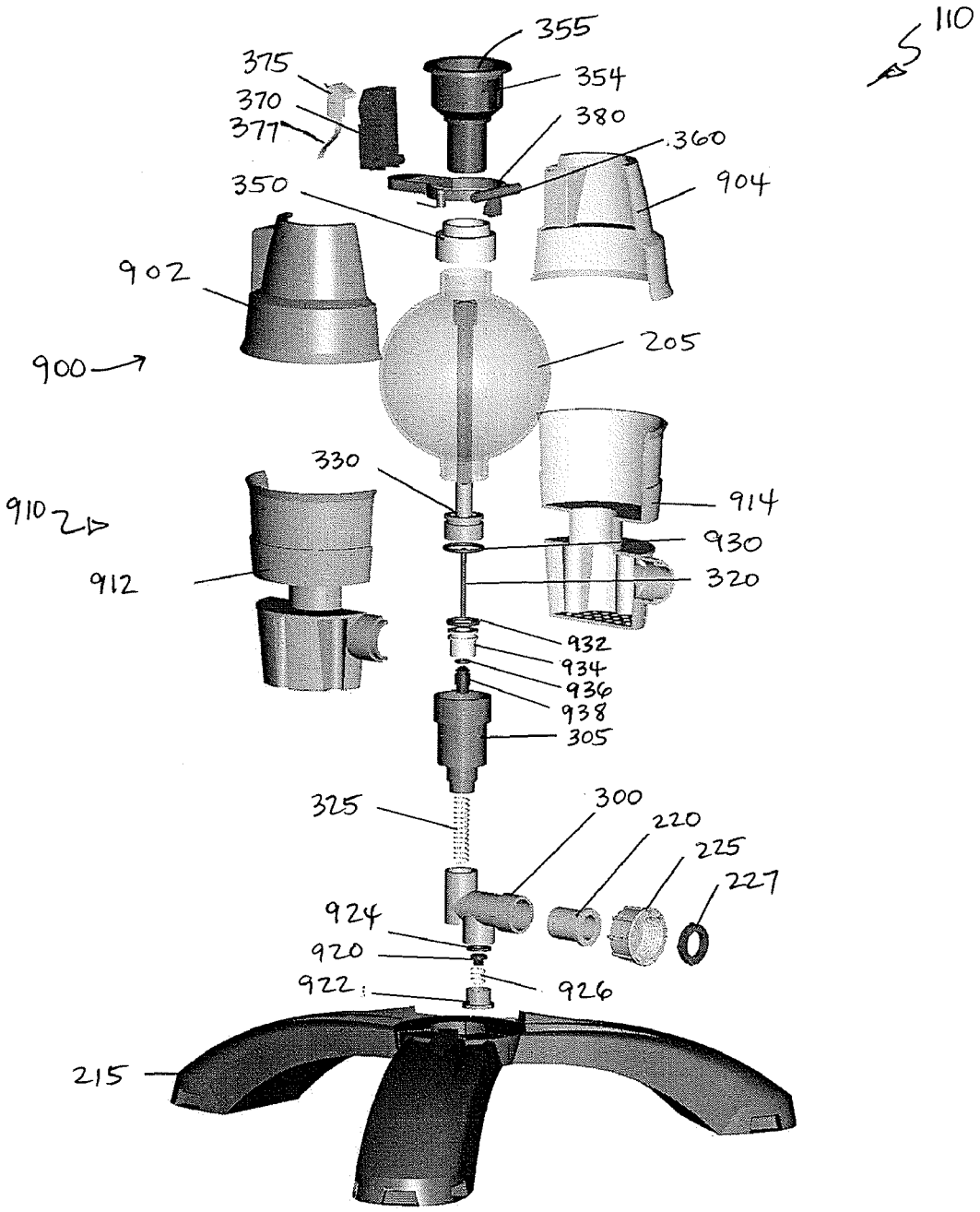
FIG. 3B illustrates an exploded view of the filling station shown in FIG. 2.
Figure 3C:
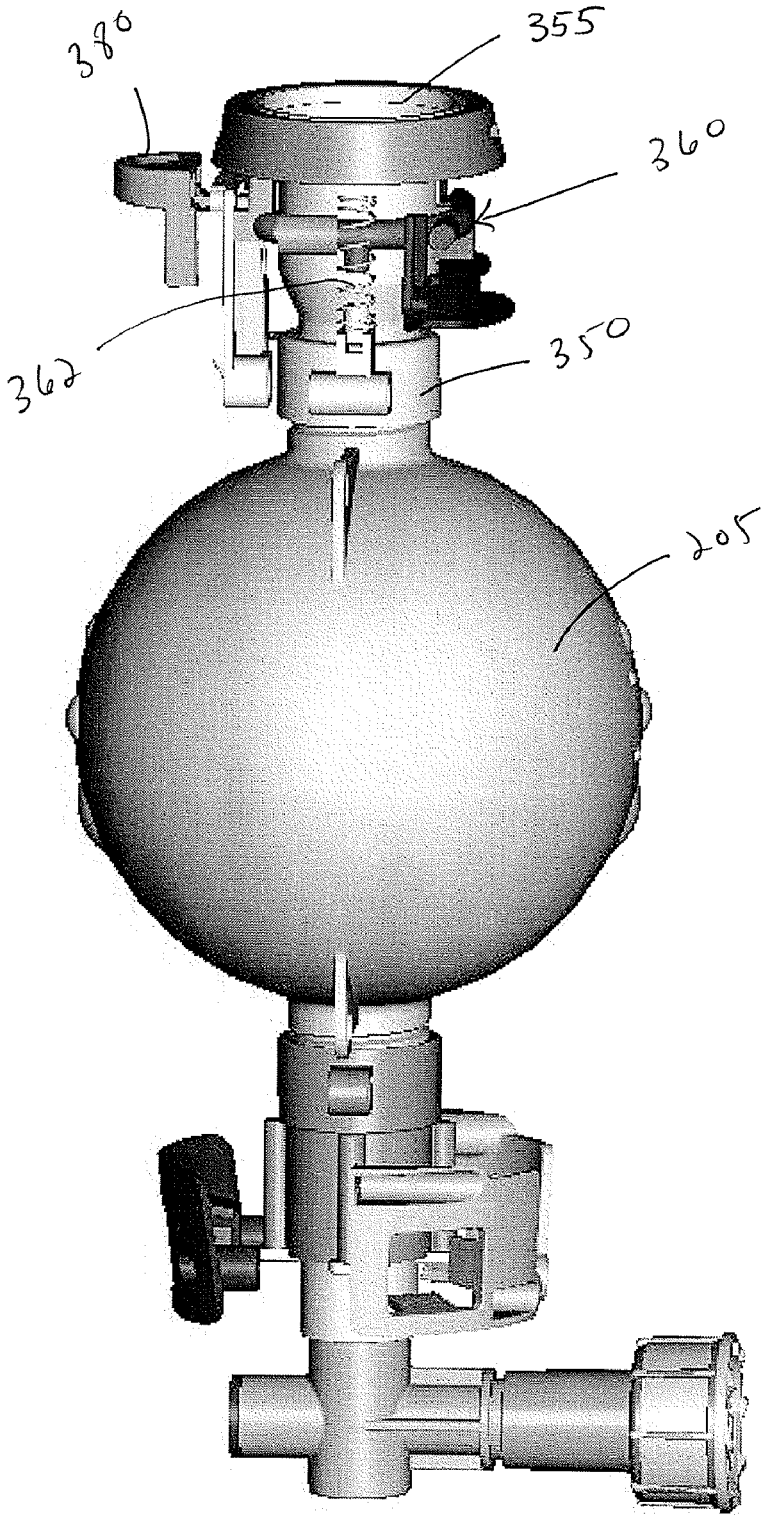
FIG. 3C illustrates an internal view of the filling station shown in FIG. 2.

FIGS. 3A and 3B show cross-sectional and exploded views, respectively, of the filling station. FIG. 3C shows an internal view of the filling station 110. In the embodiment illustrated, the lower housing 210 (see FIG. 2) houses an elbow pipe 300 in fluid communication with the port 220 to direct water from the water source connected to hose connection 225 toward the tank or reservoir 205. A lower tank cap 305 couples the elbow pipe 300 to the reservoir 205, and houses a valve chamber 310 that selectively controls the flow of water from the elbow pipe 300 to the station tank 205.

Specifically, the valve chamber 310 may include a control valve 315 having a ringnail or elongate member 320 extending therethrough. The control valve 315 is mounted on a biasing member such as a spring 325. The ringnail 320, moreover, is configured to mechanically contact a pushrod 330 extending axially through the tank 205. The pushrod 330 extends from the lower mouth 335 of the tank 205 to the upper opening/mouth 340 of the tank 205. With this configuration, the control valve 315 generally forms a one-way valve biased in its normal, closed position by the spring 325. When a downward pressure is applied to the pushrod 330, it drives the ringnail 320 downward, opening the control valve 315 and permitting the upward flow of water therethrough. The valve chamber 310 may further include a purge or relief valve 345 to relieve excess pressure by venting pressurized air and/or water when the pressure exceeds a selected point. In addition, various O-rings may be provided as desired to ensure water tight seals.

An upper tank cap 350 is coupled to the upper opening/mouth 340 of the tank 205. A funnel or receptacle 355 in fluid communication with the tank 205 is seated within the upper mouth 340 of the tank 205. The receptacle 355 is adapted to mate with the filling probe of the water gun (discussed in greater detail below).

Referring to FIG. 3B, an exploded view of the components of the filling station 110 is shown. The filling station 110 includes a tank 205 that has a top housing 900 and a lower housing 910 coupled thereto. In one embodiment, the top housing 900 is formed of two pieces 902 and 904 that are coupled together and the lower housing 910 is formed of two pieces 912 and 914 that are coupled together. The top housing 900 and the lower housing 910 substantially surround the tank 205 when they are coupled together.

As shown in FIG. 3B, the elbow pipe 300 includes a hose pipe or port 220 and a hose connector 225. A washer 227 may be used with the hose connector 225. The elbow pipe 300 also includes a safety valve 920, shown in a different position than in FIG. 3A, that includes a cap 922, a gasket 924, and a spring 926. Proximate to the ringnail 320 is an O-ring 930 for the pushrod 330 and an O-ring 932 for the cap insert 934. Beneath the cap insert 934 is a valve O-ring 936 and a main shutoff valve 938 that are located in the lower tank cap 305. At the upper end of the pushrod 330 is an upper tank cap 350. A spring 325 is located beneath the pushrod 330 and biases the pushrod 330 upwardly.

Figure 7A:
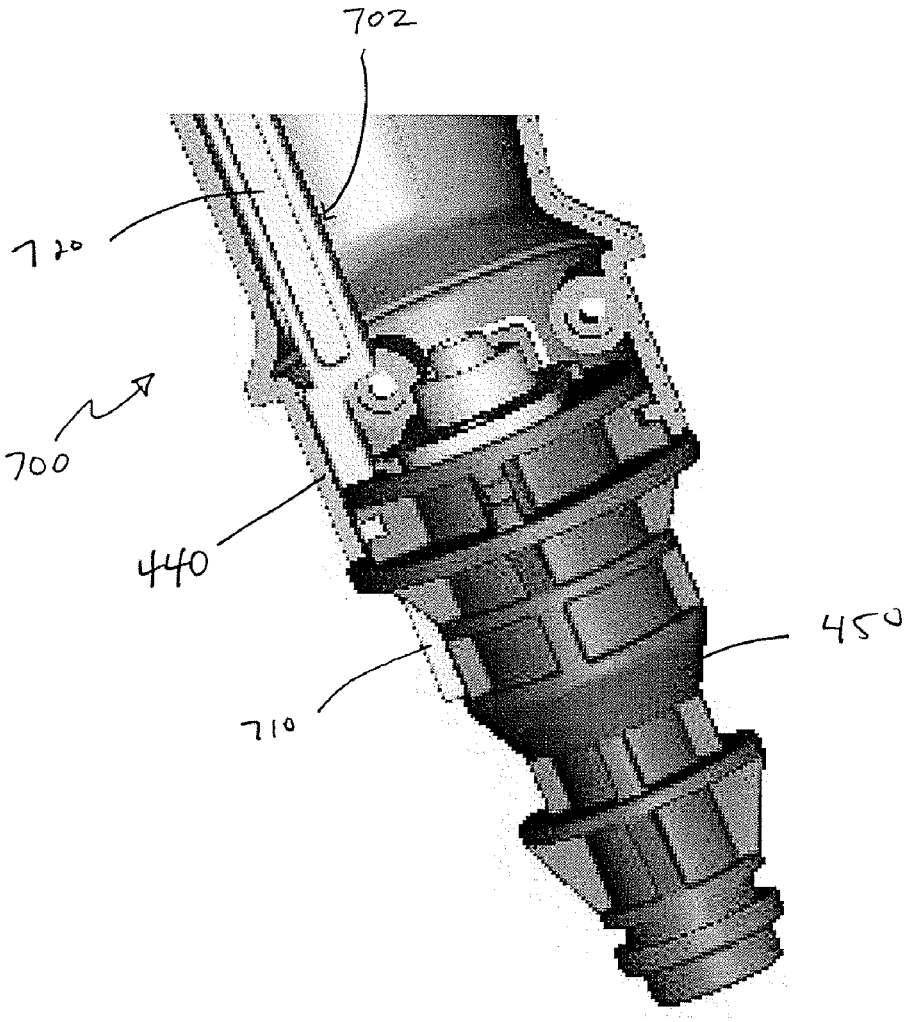
FIG. 7A illustrates a close-up view of the refill probe and trigger lockout feature.
Figure 7B:
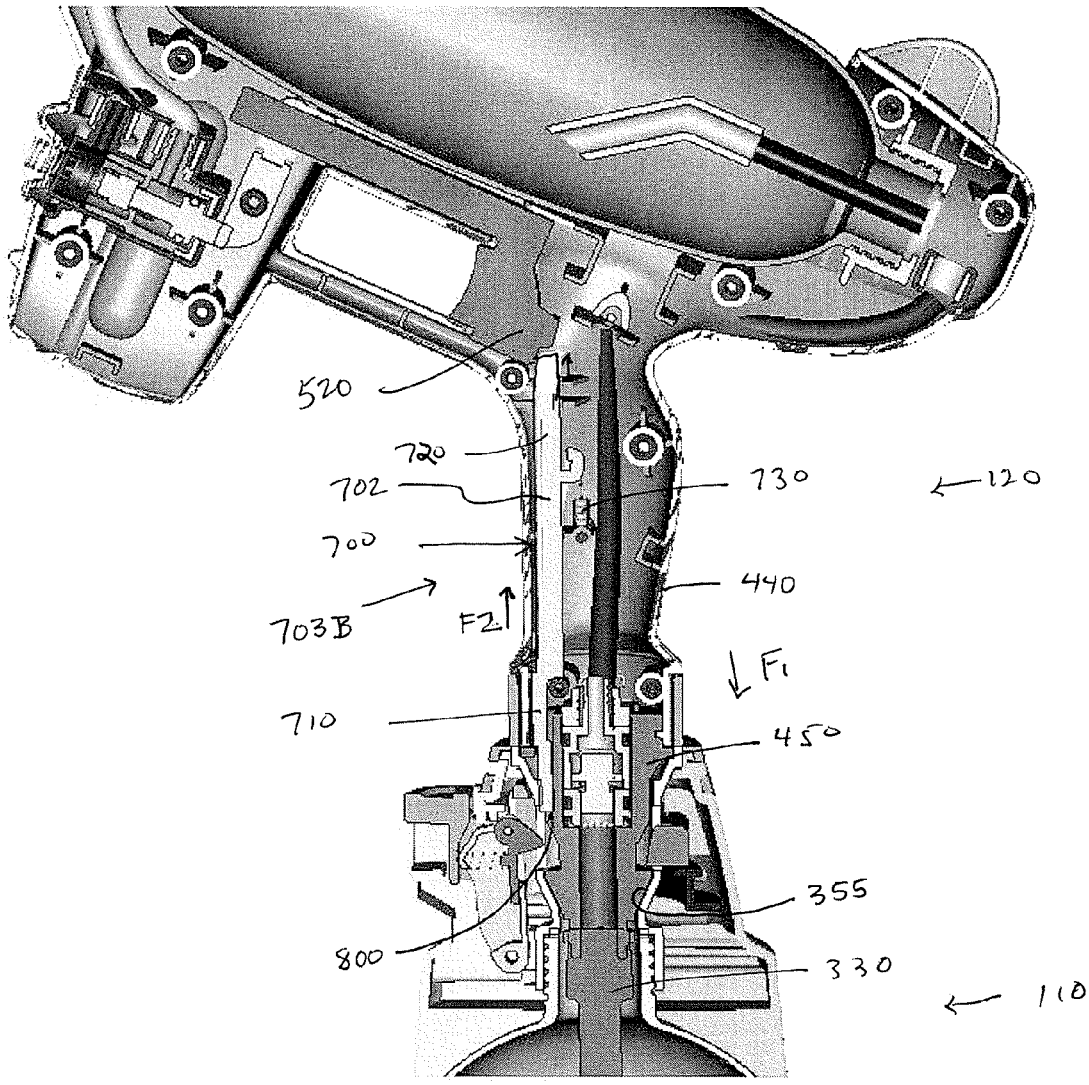
FIG. 7B illustrates a cross-sectional view of the filling station of FIG. 2 connected to the water gun of FIG. 4.

The filling station 110 includes a top ring 354 that defines the receptacle 355. Also included, and discussed in greater detail with respect to FIG. 7B, are a rocker 370 and a latch 375 with a spring portion 377. As described below, a clamp 360 is provided with a release button 380 that can be manipulated by a user.

The filling station 110 further includes a locking mechanism operable to selectively secure the water gun 120 to the filling station 110. Referring to FIG. 3C, the locking mechanism may include an annular clamp 360 mounted to the receptacle 355, with the clamp 360 being spring biased in a normal position via spring 362. The clamp 360 includes a clamp latch or finger 365 (see FIG. 3A) that extends through an opening 356 in the wall of the receptacle 355 when the clamp 360 is oriented in its normal position. As shown in FIG. 3A, a rocker 370, furthermore, controls a rocker latch or finger 375 disposed generally diametrically opposed to the clamp latch 365. As with the clamp latch 365, the rocker latch 375 extends through an opening 358 in the wall of the receptacle 355. The latches 365 and 375 are resilient, extending into the receptacle channel when the clamp 360 and rocker 370 are oriented in their normal positions. A biasing mechanism 371, such as a spring, biases the latch 375 inwardly to a locking position.

A release button 380, in communication with the rocker 370 and the annular clamp 360, may be engaged to pivot the clamp 360 such that the latches 365 and 375 are retracted from the receptacle channel. Specifically, driving the button 380 downwardly pivots the rocker 370 away from the receptacle 355, as well as pivots the clamp 360 such that the clamp latch 365 is removed from the receptacle channel. With this configuration, the locking mechanism may selectively engage the filling probe of the gun, thereby securing and permitting separation as desired (discussed in greater detail below).

Figure 4:
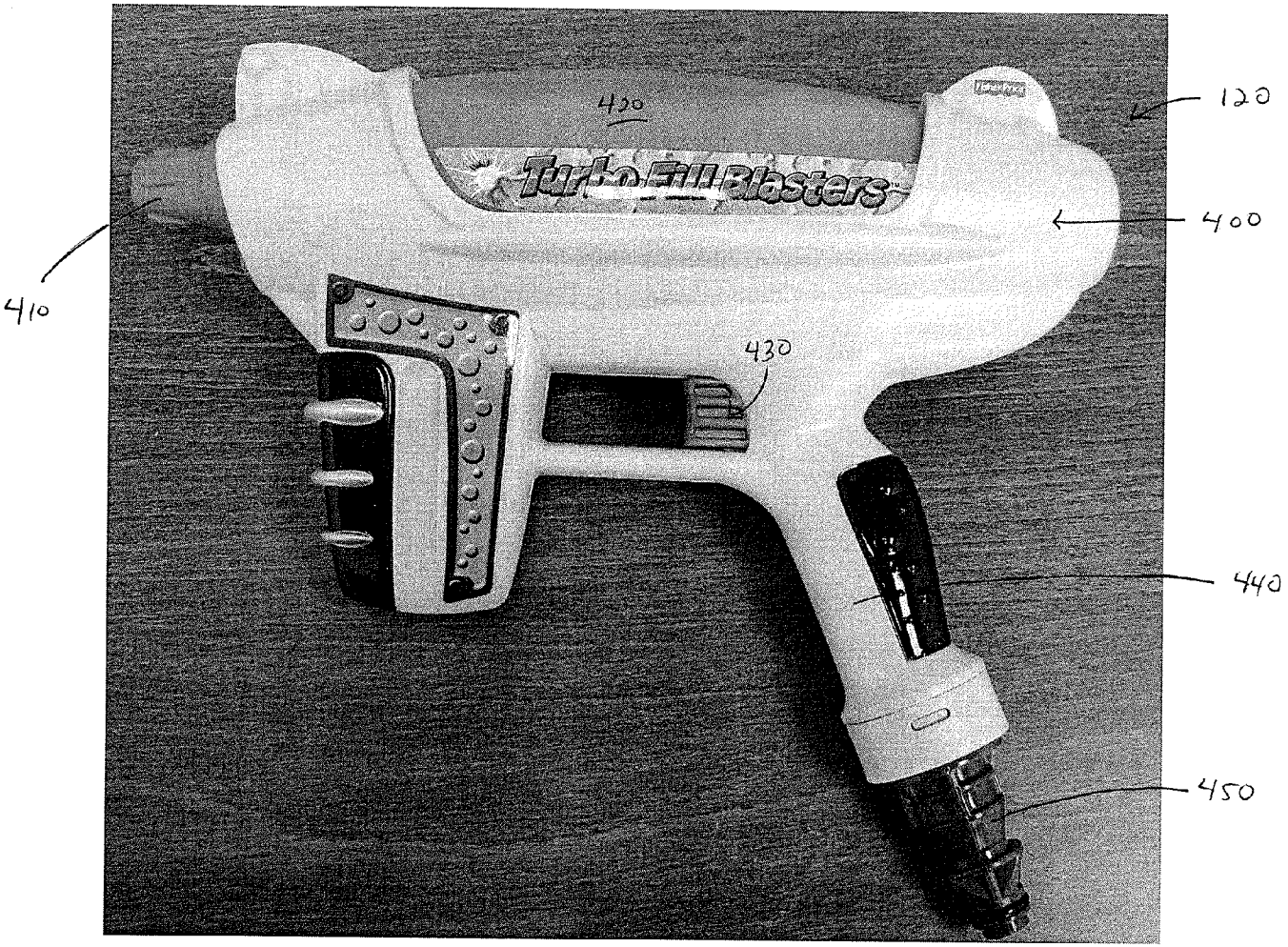
FIG. 4 illustrates a side view of a water gun in accordance with an embodiment of the invention.

FIG. 4 shows an isolated view of the water gun 120 in accordance with an embodiment of the present invention. As shown, the gun 120 includes a housing 400, a discharge nozzle 410, a reservoir 420, a trigger 430, and a handle 440 with a refill probe 450.

Figure 5A:
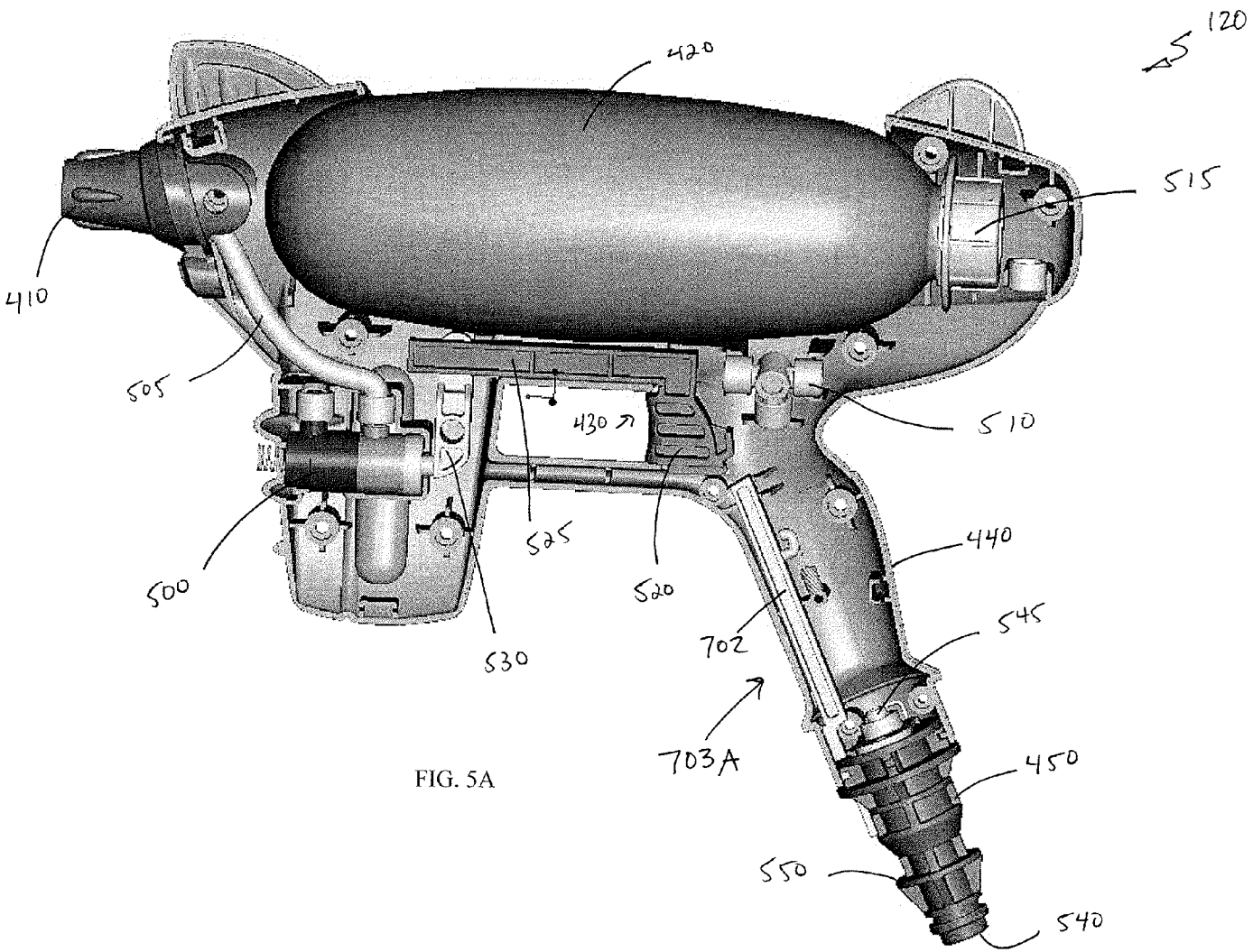
FIG. 5A illustrates a cross-sectional view of the water gun shown in FIG. 4.

FIG. 5A shows a cross-sectional view of the water gun 120. As illustrated, the nozzle 410 is in fluid communication with the outlet of a discharge chamber or valve 500 via a nozzle conduit 505. The inlet of the discharge valve 500, similarly, is coupled to a discharge valve conduit (not illustrated) running from the inlet of the valve 500 to a splitter 510. The splitter 510, in addition to receiving the second conduit from discharge valve 500, is in fluidic communication with the reservoir 420 via a reservoir conduit (not illustrated), as well as in fluidic communication with the refill probe 450 via a probe conduit (not illustrated). In one embodiment, the conduits may be tubing such as polyvinyl chloride tubing. The nozzle conduit, the discharge valve conduit, the reservoir conduit, and the probe conduit can be referred to alternatively as a first, a second, a third, and a fourth conduit, respectively.

The reservoir 420 is configured to store pressurized water. The reservoir 420 may be in the form of a generally cylindrical, open-ended container operable to store air and water. Water is introduced to the reservoir via inlet 515, which is coupled to reservoir conduit described above. Water is supplied, via the filling station 110, by a pressurized water source. As the water enters the reservoir 420, it pressurizes air inside the reservoir. As a result, the reservoir 420 stores pressurized air.

The trigger mechanism 430 selectively actuates the discharge valve 500 to generate a stream of water from the nozzle 410. The trigger mechanism 430 includes a button actuator portion 520 and a trigger rod portion 525. The trigger rod portion 525 is coupled to a linkage 530 that controls the discharge valve 500. Specifically, the trigger mechanism 430 may be biased via a biasing member (e.g., a spring, not illustrated) such that the discharge valve 500 is normally closed. Engaging the button actuator portion 520 moves the rod portion 525 backward (toward the handle 440), which in turn, drives the linkage 530 backward, opening the discharge valve 500 and permitting the flow of water from the valve 500 to the nozzle 410. Upon releasing the trigger mechanism 430, the biasing member returns the trigger mechanism 430 to its normal position, closing the discharge valve 500.

The refill probe 450 is received by the receptacle 355 of the filling station 110 to form a generally fluid tight connection. The refill probe 450 includes a probe inlet 540 and a probe outlet 545 that is in fluid communication with the probe conduit (described above). The refill probe 450 may house a one-way valve permitting the flow of fluid from the inlet 540 to the outlet 545. One or more O-rings may be utilized to provide fluid tight seals between the refill probe 450 and the handle 440, as well as the refill probe 450 and the receptacle 355. The refill probe 450 includes a shoulder 550 that is engaged by the latches 365, 375 of the filling station 110.

Figure 5B:
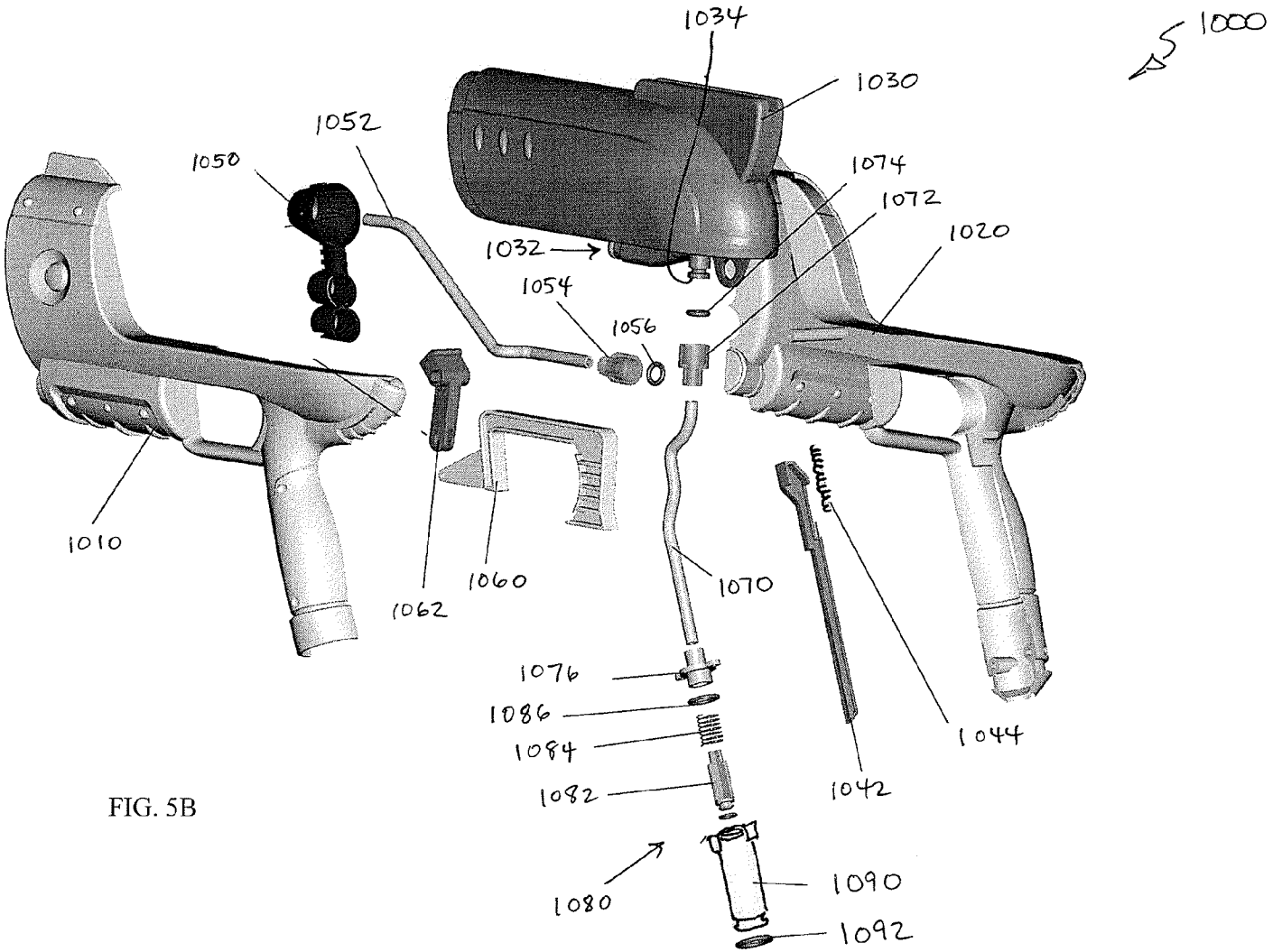
FIG. 5B illustrates an exploded view of an alternative embodiment of a water gun in accordance with an embodiment of the invention.

Referring to FIG. 5B, an alternative embodiment of a water gun according to the invention is illustrated. It is to be understood that some components of the water gun 1000 are not illustrated for ease of reference. In this embodiment, the water gun 1000 includes two body portions 1010 and 1020 that capture a tank or reservoir 1030 therebetween. The water gun 1000 includes a lockout mechanism 1040 that includes a lockout linkage 1042 and a spring 1044 for the trigger lockout feature. In this embodiment, the water gun 1000 includes a discharge nozzle 1050 with a nozzle component (not shown) that is coupled to one end of tubing 1052, such as silicone tubing. The other end of the tubing 1052 is coupled to a cap 1054 that includes an O-ring 1056 and is connected to the outlet 1032 of the tank 1030. A trigger 1060 and a trigger linkage 1062 that is coupled to the trigger 1060 are illustrated. The trigger linkage 1062 is biased by a spring (not shown) into a closed position in which water or other liquid is not discharged through the discharge nozzle 1050.

The gun 1000 also includes another piece of tubing 1070 that is connected at one end to a cap 1072 with an O-ring 1074. The cap 1072 is connected to an inlet opening or port 1034 of the tank 1030. In one embodiment, the tubing 1070 is made of polyvinyl chloride. The other end of the tubing 1070 has a component 1076 connected thereto. A valve 1080 is disposed proximate to the component 1076 as shown. The valve 1080 includes a valve body 1082, a spring 1084 and a gasket 1086. The valve 1080 is located within a probe section 1090 of the gun 1000. An inlet screen (not shown) may be located upstream of the valve body 1082. An O-ring 1092 is provided proximate to the probe section 1090 to seal the connection between the gun 1000 and the filling station.

Figure 6:
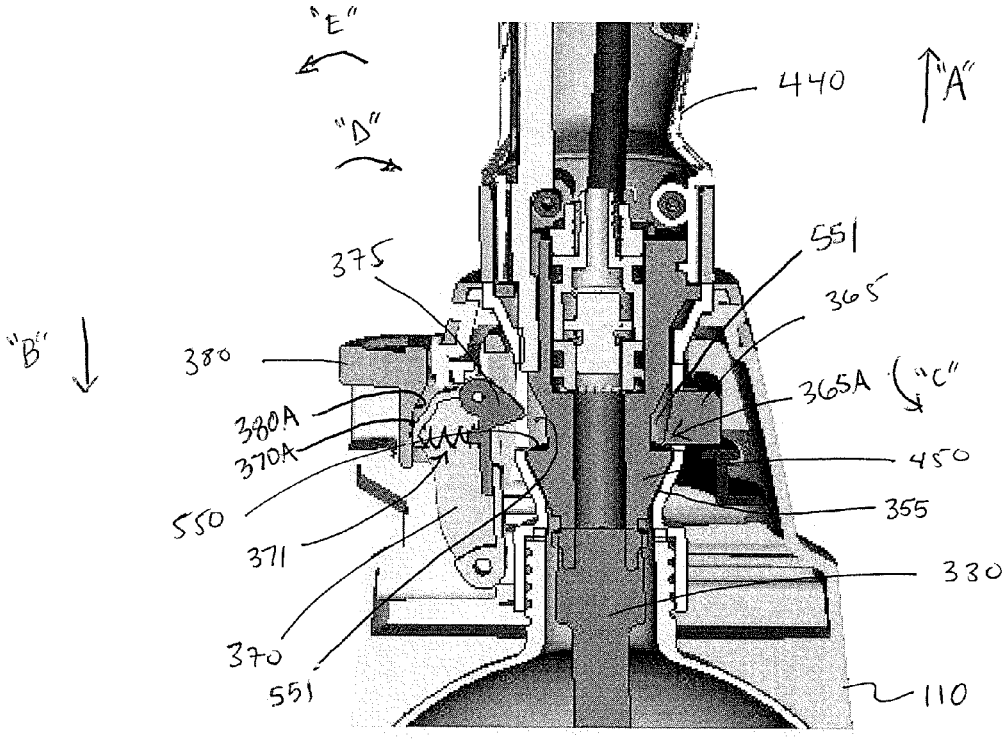
FIG. 6 illustrates a close-up, cross-sectional view of the filling station of FIG. 2 connected to the water gun of FIG. 4, showing the locking and release mechanisms.

Referring to FIG. 6, the operation of the water gun 120 is illustrated. In one embodiment, the refill probe 450 is inserted axially into the receptacle 355 of the filling station 110. If the probe 450 is inserted a sufficient distance, the probe 450 engages the pushrod 330 as shown. Once the shoulder 550 travels past the latches 365 and 375, the latches 365 and 375 pivot toward the probe 450, thereby preventing the refill probe 450 (including the shoulder 550) from disconnecting from the filling station 110. As shown, a biasing mechanism 371, such as a spring, biases or forces the latch 375 inwardly. The release 380 engages the rocker 370 and allows the rocker 370 to move relative to the probe 450. As a result, the removal of the probe 450 is prevented and the gun 120 is secured to the filling station 110, thereby eliminating the inadvertent removal of the gun 120 from the filling station 110. To separate the gun 120 from the filling station 110, the button release 380 is engaged, which moves the latches 365 and 375 outwardly until the latches 365 and 375 clear the shoulder 550. Once the shoulder 550 is cleared, the probe 450 may be removed from the receptacle 355.

In an alternative embodiment, referring to FIG. 6, the release 380 is coupled to the latch 365. In the position shown in FIG. 6, the latch 365 extends into the recess 551 that is defined by shoulder 550 and which extends around the perimeter of the probe 450. The engagement of latch 365 with shoulder 550 prevents the refill probe 450 from decoupling from the filling station 110 and moving along the direction of arrow "A." When the release 380 is moved downward along the direction of arrow "B," the latch 365 pivots along the direction of arrow "C" and the corner 365A disengages from the recess 551 and clears the shoulder 550. At the same time, the movement of the release 380 downward causes the inner surface 380A to slide along the outer surface 370A of the rocker 370 which is coupled to latch 375. Movement of release 380 along the direction of arrow "B" causes the rocker 370 and latch 375 to pivot inwardly along the direction of arrow "D." The latch 375 then engages the recess 551 and the shoulder 550, thereby preventing the disengagement of the refill probe 450 from the filling station 110 while the release 380 is pressed downward. Thus, the probe 450 moves along the direction of arrow "A" until latch 375 engages the shoulder 550. That movement of the probe 450 allows the pushrod 330 to move upwardly and close the supply of water from the filling station 110. When the user disengages the release 380, the release 380 moves upward and the rocker 370 and latch 375 pivot along the direction of arrow "E." At this point, the shoulder 450 clears latch 365 and latch 375 and the probe 450 can be removed from the filling station 110.

In one embodiment, the water gun 120 also includes a lock mechanism or trigger lockout 700 that is operable to secure the trigger mechanism 430 in an unactivated/closed position to prevent discharge of fluid from the gun 120 while the gun 120 is mounted on the filling station 110. Referring to FIGS. 7A and 7B, the trigger lockout 700 includes a lockout linkage or shaft 702 that can be referred to as a locking member or movable member. The shaft 702 has a receptacle-engaging portion or tab 710 and a trigger-engaging portion 720 extending upward from the tab 710. As shown, the trigger-engaging portion 720 extends toward the button actuator portion 520 of the trigger mechanism 430. The shaft 702 translates or slides axially within the body or handle of the gun 120, and is biased in a normal position via a biasing member such as a spring 730 (see FIG. 7B). In its normal, lower position 703A (shown in FIG. 5A), the tab 710 extends outward from the handle 440 of the gun 120 and is positioned along the exterior of the refill probe 450 (see FIG. 7A). The lower position 703A can be referred to alternatively as a released position or unlocking position. In its engaged, upper position 703B (shown in FIG. 7B), the tab 710 is moved along the direction of arrow F2 in FIG. 7B into the handle 440, and the upper end of the trigger-engaging portion 720 is positioned directly behind the button actuator 520 of the trigger mechanism 430, thereby preventing the movement of the button actuator 520 from its position shown in FIG. 5A in which liquid is discharged from the reservoir and its position shown in FIG. 7B in which liquid is not discharged from the reservoir. Accordingly, the button actuator 520 cannot be moved by the user in this arrangement. The upper position 703B can be referred to alternatively as a locked position or locking position.

Figure 8:
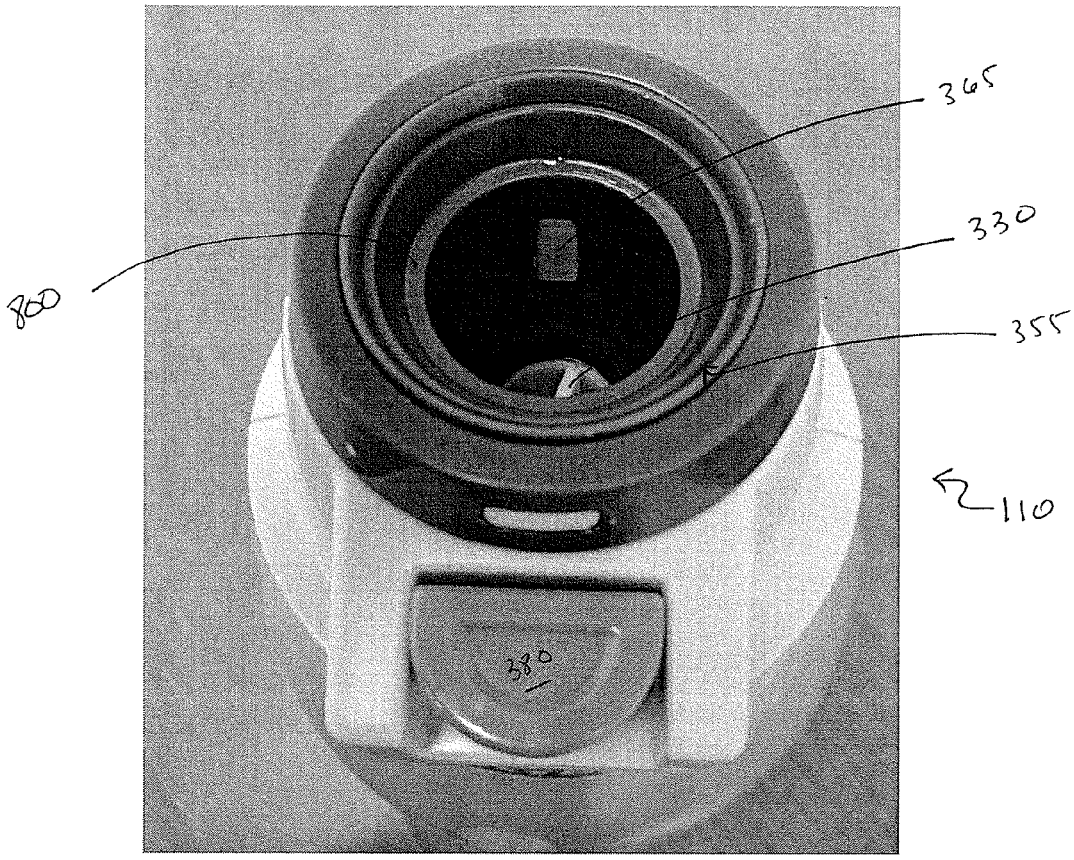
FIG. 8 illustrates a top view in perspective of the receptacle of the filling device.
Figure 9:
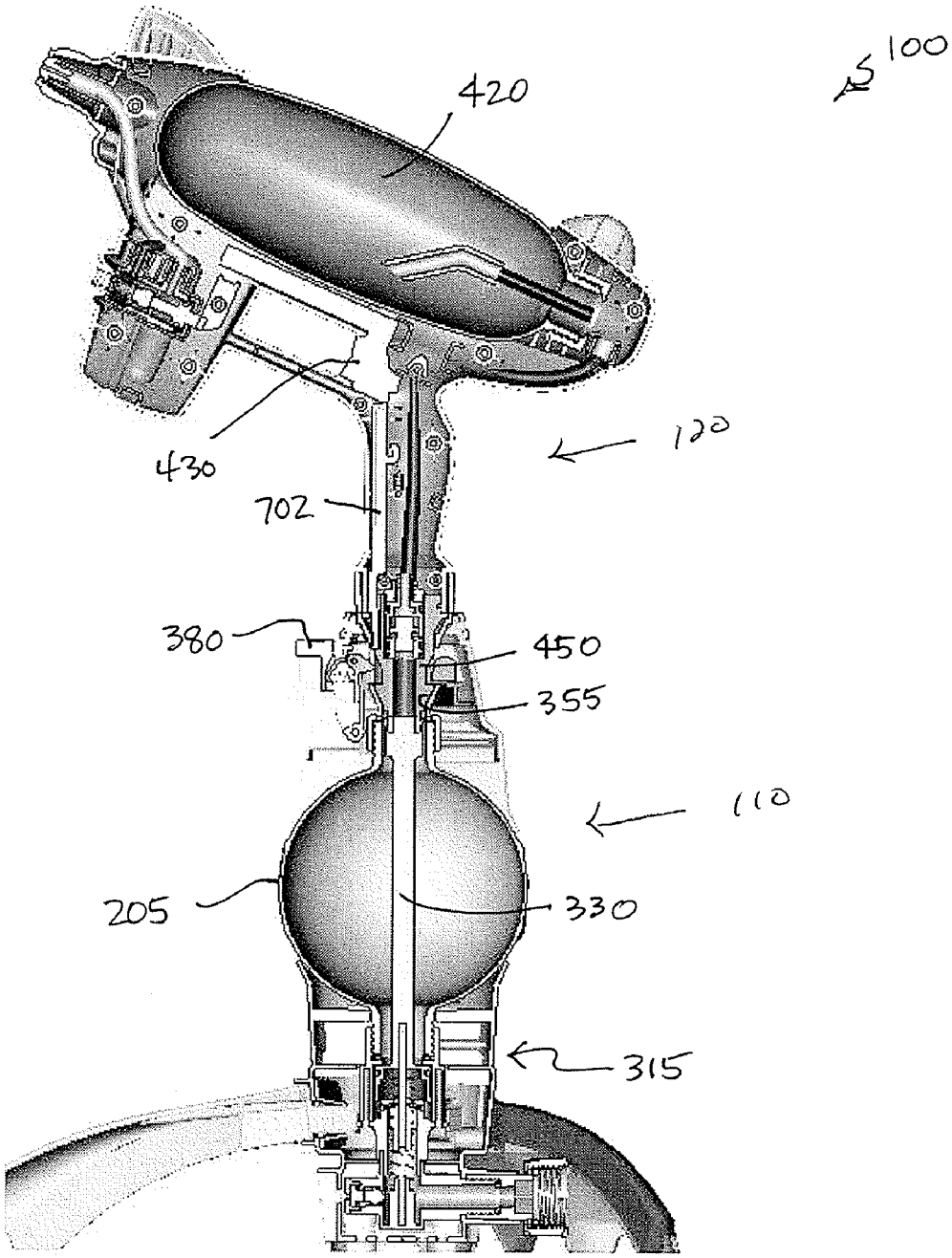
FIG. 9 illustrates a cross-sectional view of the filling station of FIG. 2 connected to the water gun of FIG. 4.

FIG. 8 shows a top perspective view of the filling station 110. As illustrated, the receptacle 355 includes an abutment surface or lip 800, which is configured to engage the tab 710 on the water gun 120 when the probe 450 is inserted into the receptacle 355. The pushrod 330 and latch 365 are also illustrated in FIG. 8. When the tab 710 is engaged with the abutment surface 800, the locking member 702 is maintained in its locked position relative to the trigger mechanism.

Referring back to FIG. 7B, the shaft 702 begins in its normal position. Axially inserting the refill probe 450 into the receptacle 355 along the direction of arrow F1 causes the lip 800 on the filling station 110 to engage the exposed tab or end 710 of the shaft 702. Urging the refill probe 450 into the receptacle 355 exerts an upward force on the shaft 702 along the direction of arrow F2, which drives the shaft 702 upwardly toward the button actuator 520 of the trigger mechanism 430. In its engaged position, the trigger portion 720 of the shaft 702 mechanically contacts the button actuator 520 of the trigger mechanism 430 to prevent the rearward translation of the trigger mechanism 430. Thus, when the water gun 120 is mounted onto the filling station 110, the trigger lockout 700 is engaged, thereby preventing discharge of the gun 120 during the filling process.

The operation of the water gun assembly 100 is explained with reference to FIGS. 7A, 7B, 8, and 9. To fill the gun 120, the refill probe 450 is inserted into the receptacle 355 of the filling station 110. The inlet of the probe 450 engages the filling station pushrod 330. Urging the refill probe 450 downwardly into the receptacle 355 drives the pushrod 330 downwardly, thereby opening the valve 315 as described above. At this time, the linkage 702 locks the trigger mechanism 430, and the latches 365 and 375 engage the shoulder 550 of the refill probe 450. Once the control valve 315 is opened, water from a pressurized water source flows into the tank 205, through the refill probe 450, and into the reservoir 420.

To disconnect the refill probe 450 from the filling station port, the release button 380 is engaged. As a result, the latches 365 and 375 release the refill probe 450, permitting separation of the water gun 120 from the filling station 110. Since the pushrod 330 is spring biased, once the latches 365 and 375 clear the shoulder 550 of the refill probe 450, the biasing force of the pushrod 330 drives the gun handle 440 upward to aid in the separation. Once separated, a user may use the gun 120 by selectively discharging water from the reservoir 420.

Accordingly, the previously described assembly provides a water gun and a filling station that automatically fills the water gun. The water gun is filled while simultaneously securing the trigger of the water gun in a locked position to prevent discharge of the gun while mounted to the station (i.e., to prevent discharge during filling).

While the invention has been described in detail and with reference to specific embodiments thereof, it will be apparent to one skilled in the art that various changes and modifications can be made therein without departing from the spirit and scope thereof. For example the assembly may be formed from any suitable materials. Thus, it is intended that the present invention cover the modifications and variations of this invention that come within the scope of the appended claims and their equivalents. It is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration.

What is claimed is:

1. A water gun assembly comprising:

a filling station operable to connect to a pressurized fluid source including:

an inlet adapted to connect to the water source, and an outlet; and a water gun including:

a trigger mechanism operable to move from an opened position, in which fluid is discharged from the gun, to a closed position, wherein discharge of fluid from the gun is prevented, and a lock mechanism configured to selective secure the trigger mechanism in the closed position, the mounting of the gun onto the filling station activating the lock mechanism securing the trigger mechanism in its closed position.

2. The water gun assembly of claim 1, wherein the filling station outlet includes a receptacle and the gun includes a probe that is received by the receptacle to form a fluid tight connection between the gun and the filling station.

3. The water gun assembly of claim 1, wherein the lock mechanism includes a locking member that is movable between a locked position and a released position relative to the trigger mechanism, the locking member in its locked position preventing the trigger mechanism from moving to its opened position.

4. The water gun assembly of claim 3, wherein the locking member is moved to its locked position when the water gun is mounted on the filling station.

5. The water gun assembly of claim 3, wherein the lock mechanism includes a biasing mechanism that biases the locking member in its released position.

6. The water gun assembly of claim 3, wherein the trigger mechanism can be moved between its opened position and its closed position when the locking member is in its released position.

7. The water gun assembly of claim 3, wherein the locking member engages the trigger mechanism when the locking member is in its locked position.

8. The water gun assembly of claim 1, wherein the filling station includes a portion defining a receptacle and the gun includes an extension that is inserted into the receptacle when the gun is mounted to the filling station.

9. The water gun assembly of claim 8, wherein the portion includes an abutment surface that engages the lock mechanism to move the lock mechanism from a released position to a locked position relative to the trigger mechanism, the locking member in its locked position preventing the trigger mechanism from moving to its opened position.

10. The water gun assembly of claim 9, wherein the lock mechanism includes a locking member that slides between the locked position and the released position.

11. The water gun assembly of claim 1, wherein mounting the gun onto the filling station engages a filling station control valve, thereby opening the valve to permit the transfer of fluid to the gun.

12. A water gun, comprising:

a body including a reservoir configured to hold a liquid, the reservoir being filled by the liquid when the water gun is connected to a filling station;

a trigger mechanism coupled to the body, the trigger mechanism engageable by a user to control the discharge of any liquid from the reservoir, the trigger mechanism being movable between a first position in which liquid is discharged from the reservoir and a second position in which liquid is not discharged from the reservoir; and a lock mechanism coupled to the body, the lock mechanism being selectively engageable with the trigger mechanism and the filling station, the lock mechanism preventing movement of the trigger mechanism from its second position to its first position when the body is coupled to the filling station.

13. The water gun of claim 12, wherein the lock mechanism includes an engagement member that is movable between a locking position and an unlocking position, the engagement member in its locking position preventing movement of the trigger mechanism relative to the body, and the engagement member in its unlocking position permitting movement of the trigger mechanism relative to the body.

14. The water gun of claim 13, wherein the engagement member is moved to and maintained in its locking position when the water gun is mounted on the filling station.

15. The water gun of claim 13, wherein the engagement member is coupled to the body and is slidable between the locking position and the unlocking position.

16. The water gun of claim 13, wherein the lock mechanism includes a biasing mechanism that biases the engagement member into its unlocking position.

17. The water gun of claim 12, wherein the lock mechanism prevents movement of the trigger mechanism from its second position to its first position when the lock mechanism is engaged by the filling station.

18. A water gun, comprising:

a body including a reservoir configured to hold a liquid, the body being connectable with a filling station to supply the liquid to the reservoir;

a trigger mechanism coupled to the body, the trigger mechanism being movable between a first position in which liquid from the reservoir is discharged from the body and a second position in which liquid is not discharged from the body; and a lock mechanism selectively engageable with the trigger mechanism, the lock mechanism preventing movement of the trigger mechanism from its second position to its first position when the lock mechanism is engaged by the filling station.

19. The water gun of claim 18, wherein the lock mechanism includes a movable member that can be placed in a locking position in engagement with the trigger mechanism and in an unlocking position spaced from the trigger mechanism, the movable member being in its locking position when the movable member is engaged by the filling station.

20. The water gun of claim 19, wherein the movable member prevents movement of the trigger mechanism when the movable member is in its locking position.

* * * * *